US007770894B2

(12) United States Patent
Watanabe et al.

(10) Patent No.: US 7,770,894 B2
(45) Date of Patent: Aug. 10, 2010

(54) PRIZE ACQUISITION GAME DEVICE

(75) Inventors: Hideki Watanabe, Tokyo (JP); Kojiro Miyamoto, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 0 days.

(21) Appl. No.: 12/461,332

(22) Filed: Aug. 7, 2009

(65) Prior Publication Data

US 2009/0295095 A1 Dec. 3, 2009

Related U.S. Application Data

(62) Division of application No. 11/094,208, filed on Mar. 31, 2005, now Pat. No. 7,648,142.

(30) Foreign Application Priority Data

Mar. 31, 2004 (JP) ..... 2004-107037
Feb. 17, 2005 (JP) ..... 2005-041299

(51) Int. Cl.
*A63F 9/30* (2006.01)

(52) U.S. Cl. ..... 273/448

(58) Field of Classification Search ..... 273/440, 273/447, 448
See application file for complete search history.

(56) References Cited

U.S. PATENT DOCUMENTS 5,397,134 A 3/1995 Fishman et al.
6,695,698 B1 * 2/2004 Anghelo et al. ..... 463/25
7,648,142 B2 * 1/2010 Watanabe et al. ..... 273/448
7,654,534 B2 * 2/2010 Matsuda ..... 273/448
2005/0218602 A1 10/2005 Watanabe et al.
2006/0170164 A1 8/2006 Watanabe
2008/0001360 A1 1/2008 Fukazawa
2008/0242413 A1 * 10/2008 Matsuda ..... 463/38
2009/0295095 A1 * 12/2009 Watanabe et al. ..... 273/448

FOREIGN PATENT DOCUMENTS

JP 2001-157773 A 6/2001

* cited by examiner

*Primary Examiner*—Raleigh W. Chiu
(74) *Attorney, Agent, or Firm*—Finnegan, Henderson, Farabow, Garrett & Dunner, L.L.P.

(57) ABSTRACT

Provided is a prize acquisition game device in which a control unit constituted from a microcomputer controls a prize acquisition unit that moves in a game space with a plurality of prizes disposed therein, and controls the acquisition of the prize. The control device moves the prize acquisition unit to the target prize based on an operation signal, judges the success of the acquisition of the prize, and moves the prize acquisition unit that acquired the prize to apposition where the prize can be paid out to the player. And an obstruction unit for obstructing the prize while it is being transported, or when the prize is to be dropped in the prize payout slot has been provided.

4 Claims, 15 Drawing Sheets

<PATH OBSTRUCTION TYPE>

<PRIZE DROP-IN OBSTRUCTION TYPE>

<PRIZE DROP-IN OBSTRUCTION TYPE>

(1)

(2)

<PRIZE DROP-IN OBSTRUCTION TYPE>

PRIZE ACQUISITION GAME DEVICE

This is a division of application Ser. No. 11/094,208, filed Mar. 31, 2005, now U.S. Pat. No. 7,648,142 which claims priority under 35 U.S.C. §119 of Japanese Patent Application No. 2004-107037, filed on Mar. 31, 2004, and Japanese Patent Application No. 2005-041299 filed on Feb. 17, 2005, all of which are incorporated herein by reference.

BACKGROUND OF THE INVENTION

1. Field of the Invention

The present invention generally relates to a prize acquisition game device, and in particular relates to a prize acquisition game device with an added function of improving the amusement of game play by obstructing the acquisition of prizes.

2. Description of the Related Art

As this type of prize acquisition game device, for example, there is a device described in Japanese Patent Laid-Open Publication No. 2001-157773. The object of the invention described in the foregoing gazette is to provide a prize acquisition auxiliary device for a prize acquisition game machine capable of increasing chances of acquiring a prize and giving a chance of acquiring a prize to a beginner, and, as illustrated in FIG. 1 of this gazette, this prize acquisition auxiliary device has a prize catching means 11 for catching a prize K dropped from a prize carrying means 30 before reaching a prize acquisition position H and carrying the prize K to the prize acquisition position H. Even if the prize K is dropped from the prize carrying means on the way because the holding condition of the prize K by the prize carrying means 30 is weak, the prize K can be caught by the prize catching means 11, so that a player can acquire the prize K.

With this prize acquisition game device, an arm is connected to a disk-shaped mechanical unit in an openable and closable manner, a claw is provided at the tip of this arm, and this claw is used to grab and acquire the prize. As a result of a player operating the operation button provided to the case, the mechanical unit is moved to the target position in the X-Y direction for acquiring the prize, thereafter moved to the prize drop-in slot regardless of whether or not the prize was acquired, and the mechanical unit then opens the arm and drops the prize toward the prize drop-in slot if a prize has been acquired.

Conventionally, in this kind of prize acquisition game machine, from the perspective of seeking the amusement of game play, several proposals have been made for adding difficulty in acquiring the prize. As one such example, the shape or material of the claw for grabbing the prize can be changed. A plurality of claws having different shapes is fitted to the tip of the arm so as to adjust the difficulty. Secondly, the shape or material of the arm can be changed. A plurality of arms having different shapes is provided so as to adjust the difficulty upon acquiring the prize. Thirdly, the operation reaction timing can be shifted. In other words, by delaying the reaction of the operation target a predetermined time, such as when the mechanical unit is moved based on the player's operation, the player's operation for acquiring the prize can be made difficult. Fourthly, the gripping strength of the claw upon acquiring the prize can be adjusted. The spring for adjusting the elastic force upon the claw opening and closing can be changed, or the spring can be automatically extended to increase the elastic force. These are well-known adjustment means for adjusting the arm, claw or mechanical unit for opening and closing the arm.

The progress of the game in such a prize acquisition game machine is as follows. A player operates a button or lever provided to the case to control the motion mechanism of the prize acquisition unit, places the prize acquisition unit above the prize, releases the arm of the prize acquisition unit and lowers the prize acquisition unit toward the prize. Further, after the arm contacts the prize, the arm closes to pick up the prize. Next, the moving means, which picks up the prize and moves it above the prize drop-in port, moves the prize acquisition means. Next, the arm is released to drop the prize in the prize drop-in port (drop-in slot). As a result of clearing all of these stages, the player is able to acquire one's target prize.

Conventional prize acquisition game machines, however, have the following problems. The player would only concentrate up to a stage of picking up the prize, and the movement of the game machine remained monotonous. For example, if the player is not able to grab the prize, the game would be over. In other words, whether or not a player is able to grab the prize was the primary factor of determining the amusement of game play.

Meanwhile, consideration has not been conventionally given to provide diversity in the game play by keeping the player nervous even after he/she grabs the prize such as by creating a phenomenon of a case where the prize that was once grabbed could drop from the prize acquisition means before it reaches the drop-in slot.

Thus, an object of the present invention is to provide a game machine with increased tension in a prize acquisition game by extending the adjustment of difficulty upon a user acquiring a prize until the prize acquired with the prize acquisition unit is thereafter paid out.

SUMMARY OF THE INVENTION

In order to achieve the foregoing object according to the present invention, the present invention provides a prize acquisition control method in a prize acquisition game device in which a control means constituted from a microcomputer controls a prize acquisition means that moves in a game space with a plurality of prizes disposed therein, and controls the acquisition of the prize, wherein the control means implements: a step of moving the prize acquisition means to a target prize based on an operation signal from an operation means operated by a player; a step of moving the prize acquisition means that acquired the prize to a position where the prize can be paid out to the player; and a step of obstructing the payout of the prize before the prize acquisition means pays out the prize at the payout position.

Further, the present invention also provides a prize acquisition control method in a prize acquisition game device in which a control means constituted from a microcomputer controls a prize acquisition means that moves in a game space with a plurality of prizes disposed therein, and controls the acquisition of the prize, wherein the control means implements: a step of moving the prize acquisition means to a target prize based on an operation signal from an operation means operated by a player; a step of moving the prize acquisition means that acquired the prize to a position where the prize can be paid out to the player; and a step of driving an obstruction means for applying physical obstructive force to the prize acquisition means before the prize acquisition means reaches the payout position.

Further, the present invention also provides a prize acquisition game device, comprising: an operation means to be operated by a player; a game space with a plurality of prizes disposed therein; a prize acquisition means disposed movably in the game space; a vibration means for vibrating the prize acquisition means; a moving means for moving the prize acquisition means; and a control means for controlling the moving means to move the prize acquisition means from an initial position to a target position in response to an operation signal from the operation means; wherein the control means controls the vibration means to vibrate at a prescribed cycle until the prize acquisition means returns from the target position determined by the operation of the player to the initial position.

Further, the present invention also provides a prize acquisition game device, comprising: an operation means to be operated by a player; a game space with a plurality of prizes disposed therein; a prize acquisition means disposed movably in the game space; a moving means for moving the prize acquisition means at least in the left/right directions, front/back directions or up/down directions in relation to the player positioned facing the game space; and a control means for controlling the moving means to move the prize acquisition means from an initial position to a target position in response to an operation signal from the operation means; wherein the control means controls the moving means to move the prize acquisition means at least in the left/right directions, front/back directions or up/down directions until the prize acquisition means returns from the target position determined by the operation of the player to the initial position.

Further, the present invention also provides a prize acquisition game device, comprising: an operation means to be operated by a player; a game space with a plurality of prizes disposed therein; a prize acquisition means disposed movably in the game space; a moving means for moving the prize acquisition means in the game space; a control means for controlling the moving means to move the prize acquisition means from an initial position to a target position in response to an operation signal from the operation means; and an obstruction means provided in the middle of the path where the prize acquisition means returns from the target position to the initial position, and for obstructing the acquisition of the prize with the prize acquisition means.

Further, in the present invention, the obstruction means is constituted to reciprocate between a position that contacts the prize and a position that does not contact the prize acquired with the prize acquisition means moving along the path.

Further, the present invention also provides a prize acquisition game device, comprising: an operation means to be operated by a player; a game space with a plurality of prizes disposed therein; a prize acquisition means disposed movably in the game space; an opening for ejecting the prize dropped from the prize acquisition means outside the game space; a moving means for moving the prize acquisition means in the game space; a control means for controlling the moving means to move the prize acquisition means to a target position in response to an operation signal from the operation means; and an obstruction means for obstructing, with an obstruction member provided to the opening, the passage of the prize dropped from the prize acquisition means that was moved to a position above the opening with the moving means.

Further, in the present invention, under the control of the control means, the obstruction means drives the obstruction member so as to repeat the blocking and unblocking of the opening.

Moreover, the present invention also provides a game device further comprising an avoidance means for avoiding the obstruction means; and an avoidance operation means to be operated by the player to avoid the obstruction from the obstruction means; wherein the control means controls the avoidance means based on the operation signal received from the avoidance operation means.

Moreover, the present invention also provides a prize acquisition game device further comprising a storage means for prestoring an obstruction parameter for determining the degree of obstruction with the obstruction means, wherein the control means performs control so as to determine the obstruction parameter determined based on prescribed conditions, and drive the obstruction means based on the determined obstruction parameter.

Moreover, the present invention also provides a prize acquisition game device further comprising a notification means for notifying the player that an operation for avoiding the obstruction by the obstruction means is possible; and a detection means for detecting the success of the prize acquisition means acquiring the prize, wherein the control means performs control so as to judge the success or failure of acquisition of the prize based on the detection signal of the detection means, and make the notification means notify the player that an operation for avoiding the obstruction is possible when it judges the success of prize acquisition.

Further, the present invention also provides a game device further comprising an avoidance means for avoiding the vibration applied from the vibration means or the vibration applied from the reciprocation of the moving means; and an avoidance operation means to be operated by the player to avoid the vibration; wherein the control means controls the avoidance means based on the operation signal received from the avoidance operation means.

Further, the present invention also provides a prize acquisition game device, comprising: an operation means to be operated by a player; a game space with a plurality of prizes disposed therein; a prize acquisition means disposed movably in the game space; an opening for ejecting the prize dropped from the prize acquisition means outside the game space; a moving means for moving the prize acquisition means in the game space; a control means for controlling the moving means to move the prize acquisition means to a target position in response to an operation signal from the operation means; and an obstruction means provided adjacent to the opening, and having drive means for repeating in a prescribed cycle the movement of obstructing the drop-in of the prize to the opening, and the movement of guiding the prize to the opening.

Further, the present invention also provides a prize acquisition game device further comprising an adjustment means for adjusting, under the control of the control means, the repetition cycle of the drive means.

A vibration device composed of an "eccentric shaft" and "weight" may also be provided to the prize acquisition unit. While increasing the chances for a player to pick up the prize, the quantity of prizes to be paid out can be suppressed. In addition to the ordinary setting of difficulty (adjustment of the spring force, etc.), since the difficulty can also be changed with the obstruction means (change of vibration cycle, increase/decrease of the motor rotation), the mode and breadth of adjusting the difficulty can be increased. This is also effective for presentation.

The present invention provides a prize acquisition game machine with improved amusement of game play by expanding the adjustment of difficulty, which was conventionally limited only to the acquisition of prizes, even after the prize is acquired, and thereby diversifying the modes of acquiring the prize.

DETAILED DESCRIPTION OF THE PREFERRED EMBODIMENTS

Figure 1:
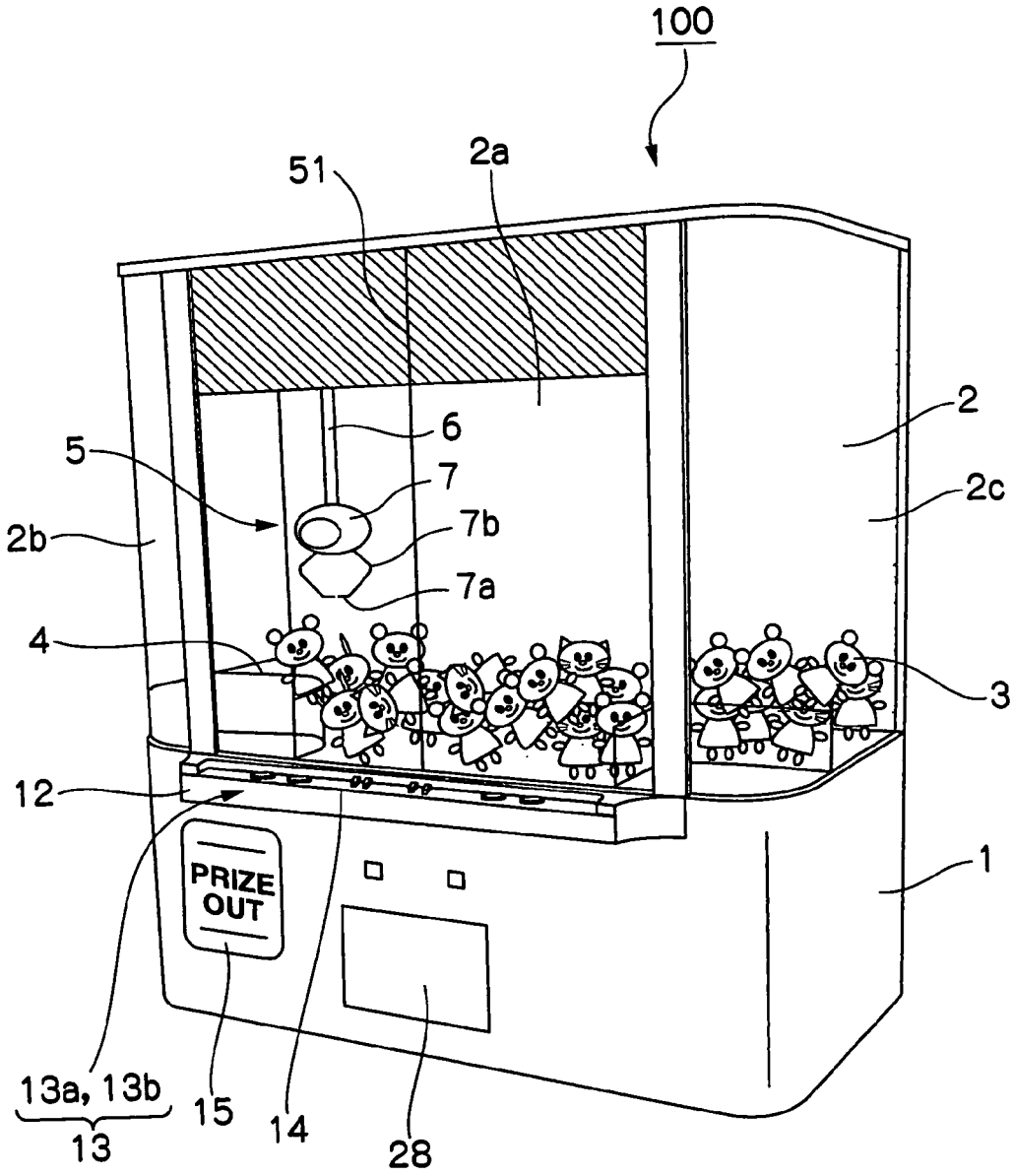
FIG. 1 is an overall perspective view of the prize acquisition game device according to the present invention.

An example of the prize acquisition game device according to the present invention is explained with reference to FIG. 1 and FIG. 2. In the prize acquisition game device 100, a box-shaped housing unit 2 is formed on a rectangular base 1. The front face 2*a* and side faces 2*b*, 2*c* of this housing unit 2 are formed from a transparent resin or glass plate-shaped member so that the prizes 3 housed inside the housing unit 2 will be visible. Further, the back face of the housing unit 2 is constituted from a plate-shaped member functioning as a mirror or a decorated plate-shaped member. A sliding door or a gatefold door 51, for example, for a store staff to house prizes in the housing unit 2 is provided to the front face 2*a* of this housing unit 2, and prizes 3 such as stuffed toys of characters or general merchandise can be housed therein. Further, a tubular prize drop-in port (opening) 4 for receiving the prize 3 is provided in a perpendicular direction at the bottom part of the housing unit 2.

Further, a prize acquisition unit 5 is hanging inside the housing unit 2. This prize acquisition unit 5 is constituted from at least an elevation means (elastic body) 6 for elevating a mechanical unit 7 in the vertical direction from the top face inside the housing unit, a mechanical unit 7 provided to the lower end thereof, an arm 7*b* that is to be opened and closed with the mechanical unit, and a claw 7*a* provided at the tip of the arm. Incidentally, a detection means (a weight sensor for instance) for detecting whether the prize has been acquired; that is, whether the arm grabbed the prize can also be provided to the prize acquisition unit.

Figure 2:
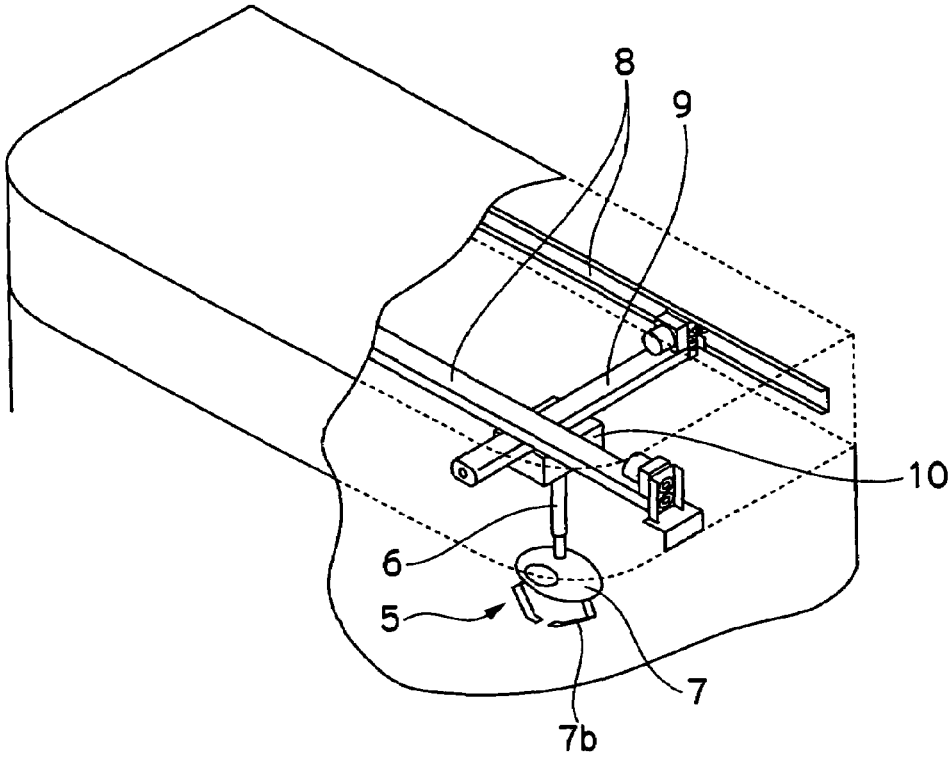
FIG. 2 is a partially enlarged view thereof.

FIG. 2 is a perspective view showing the prize acquisition game device 100 from the upper side thereof. As shown in FIG. 2, a moving means for moving the prize acquisition unit; that is, a lateral fixed rail (part of the X-direction drive mechanism) 8 and a longitudinal movable rail (part of the Y-direction drive mechanism) 9 are provided to the inner upper face of the housing unit 2, and the mechanical unit (also referred to as a gripping unit) 7 is supported with the longitudinal movable rail 9 via a prize acquisition unit base 10.

The longitudinal movable rail 9 moves along the lateral fixed rail 8. Therefore, the mechanical unit 7 is within the range of the longitudinal movable rail 9, and the longitudinal movable rail 9 is capable of traveling within the range of moving in accordance with the lateral fixed rail 8. In other words, the prize acquisition unit 5 is able to move in the lateral direction (X direction) inside the housing unit 2 by traveling along the lateral fixed rail 8, and in the longitudinal direction (Y direction) by traveling along the longitudinal movable rail 9. Further, the arm body 7*b* to be opened and closed with the mechanical unit 7 is constituted from two crab leg-shaped arms for grabbing the prize 3. Although these two arms 7*b* are normally in a closed state, they will open upon grabbing the prize. The closing force of the arm is adjusted with a spring, and stronger the spring power, the stronger the power for grabbing the prize, and the prize can therefore be acquired easier. The motion mechanism (moving means) in the respective directions is constituted from the foregoing rails and drive source.

A console 12 to be operated by the player is provided to the base 1 illustrated in FIG. 1. An operation means (button switch, joystick, etc.) 13 for moving and stopping the prize acquisition unit 5 at a position corresponding to the desired prize 3 is provided to the console 12. This operation means 13, for example, comprises a first button switch 13*a* for stopping the prize acquisition unit 5 at a prescribed position in the lateral direction, and a second button switch 13*b* for stopping the prize acquisition unit 5, in which the prescribed position thereof in the lateral direction was determined with the first button switch 13*a*, at a prescribed position in the longitudinal direction.

A coin slot 14 for the player to insert a coin upon playing the game is provided to the console 12. Further, a prize output port 15 is provided to the lower part of the base 1, and this output port 15 is in communication with a prize drop-in port 4 for passing the prize therethrough. An opening/closing door 28 is provided to the lower part of the base 1, and provided to the inside of this opening/closing door 28 are operation buttons, operation dials and an interface such as a liquid crystal display (not shown) for the store manager to configure various settings of the prize acquisition game device. When the store manager configures the various settings by operating the operation button or the like, the computer provided inside the base 1 controls the prize acquisition game device 100 based on such settings.

Next, the operation of the prize acquisition game device 100 having the foregoing constitution is explained. Foremost, in the initial state, the prize acquisition unit 5 is positioned at a position (home position) directly above the prize drop-in port 4, and, when the player inserts a coin in the coin slot 14, the game enters a game start state. Then, when the player pushes the first button switch 13*a*, the drive source is activated, and the longitudinal movable rail 9 supporting the prize acquisition unit 5 moves along the lateral direction rail 8. The player releases the first button switch 13*a* so as to stop the prize acquisition unit 5 at a position in the lateral direction corresponding to the desired prize. When the player releases the first button switch 13*a*, the longitudinal movable rail 9 will stop. Next, when the player pushes the second button switch 13*b*, the prize acquisition unit 5 will move along the longitudinal movable rail. The player then releases the second button switch 13*b* so as to stop the prize acquisition unit 5 at a desired position in the longitudinal direction. When the player releases the second button switch 13*b*, the prize acquisition unit 5 will temporarily stop, the two arms 7*a* are opened, and the gripping unit 7 is moved downward with an elevation mechanism 6. When the gripping unit 7 arrives at the position (target position) of the target prize 3 disposed at the lower part of the housing unit 2, the prize acquisition unit 5 closes the arm 7*b* (prize acquisition motion). Thereafter, the prize acquisition unit 5 moves the gripping unit 7 upward with the elevation mechanism 6 with the arm 7*b* in a closed state, and returns to the position (home position/initial position) directly above the prize drop-in port 4. And, the prize acquisition unit 5 opens the arm 7*b* above the prize drop-in port 4, performs the release operation of the prize, and thereafter ends the game.

Incidentally, the home position does not have to be directly above the prize drop-in slot.

Therefore, when the prize acquisition unit was able to grab the prize 3, the prize 3, in a state of being grabbed with the arm 7*b*, is carried to the prize drop-in port 4, and thereafter dropped in the prize drop-in port 4 with the release operation of the prize. And, the player will then remove the prize 3 from the prize output port 15.

Figure 3:
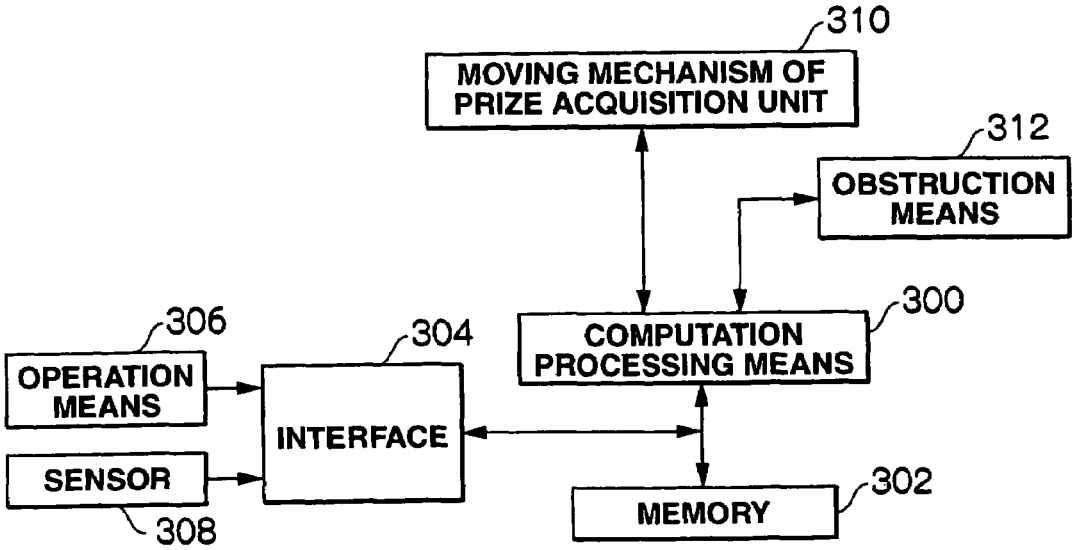
FIG. 3 is a functional block diagram of the overall control of the prize acquisition game machine.

FIG. 3 is a functional block diagram of the overall control of the prize acquisition game machine, and this control is achieved with the microcomputer built in the game machine 100. The control system depicted in FIG. 3 has a computation processing means 300 and a memory 302, and this memory stores a program for operating the game machine based on the operation signal from the console (operation device).

The input signal from an input device (306, 308) is supplied to the computation processing means 300, and the computation processing means controls the motion mechanism 310 of the prize acquisition unit and the obstruction means 312 described later. The input device is provided with the operation device 306 such as the foregoing button, and, in addition thereto, it is also provided with various sensors 308 for detecting that the gripping unit has grabbed the prize.

This obstruction means is used for adding difficulty to the acquisition of the prize by interfering with the movement or path of the prize acquisition unit, after the prize is grabbed with the arm, until the prize reaches the prize drop-in slot. In other words, this prize acquisition game device comprises a function capable of combining the setting of difficulty upon grabbing the prize as with conventional game machines, and the setting of difficulty after the prize has been acquired. As necessary, the setting of difficult of the former may be eliminated. The degree of such difficulty may be adjusted with a program. The setting of the combination of difficulty may be notified to the player with a notification means. For example, a message such as "Going is easy, returning is tough", which means the prize can be grabbed easily, but it will be difficult to transport the prize to the prize drop-in slot because the prize being transported with be subject to obstruction, can be presented. Meanwhile, when difficulty is set upon grabbing the prize, the difficulty upon transferring the prize may be set low. The difficulty upon transferring the prize may be adjusted in accordance with the difficulty upon grabbing the prize. Further, the difficulty upon grabbing the prize may be changed in accordance with the difficulty upon transferring the prize. In other words, the combination of both difficulties can be made (difficult, easy), (easy, difficult), (easy, easy), or the combination including an intermediate difficulty can also be used. Adjustment of the difficulty can be controlled with the microcomputer based on random numbers, or a player ID may be checked to change the difficulty upon determining the player's past game play results. Further, a time limit from the start of the game can be provided, and the difficulty can be changed or increased when the time exceeds such time limit.

The setting and change of difficulty upon grabbing the prize are as described in the related art, and, for example, the pulling degree of the spring may be changed with a command of the computer. The setting and adjustment of difficulty upon transferring the prize will be described later. The difficulty in this case is realized with the obstruction means in the middle of the path of the prize being transported to the opening, or the obstruction means at the moment the prize is dropped into the opening. If both obstruction means are effective, the difficulty will increase in comparison to a case where only one of such obstruction means is effective. The degree of obstruction to be conducted by this obstruction means can be adjusted with the control means.

This obstruction means applies physical power to the prize; in other words, this can be a means regarding the obstruction until the prize acquisition means carries the prize to the position of the drop-in slot, or a means regarding the obstruction immediately before or at the moment the prize is dropped in the prize drop-in slot.

As the obstruction of the former, for instance, there is the control against the X direction motion mechanism and Y direction motion mechanism. Incidentally, control may also be made against the Z direction elevation mechanism. This control is executed with the computation processing means 300 illustrated in FIG. 3. To describe an example thereof, the control unit may control the motion mechanism to make the mechanical unit 7 repeat a reciprocating motion. When the reciprocating frequency is high, the mechanical unit will vibrate, and, when the frequency is low, the mechanical unit will shake. Based on such vibration or shaking, the prize grabbed with the arm will drop from the arm more easily. This vibration or shaking is achieved with the normal/reverse rotation of the motor for moving the mechanical unit in the X, Y directions.

Figure 4:
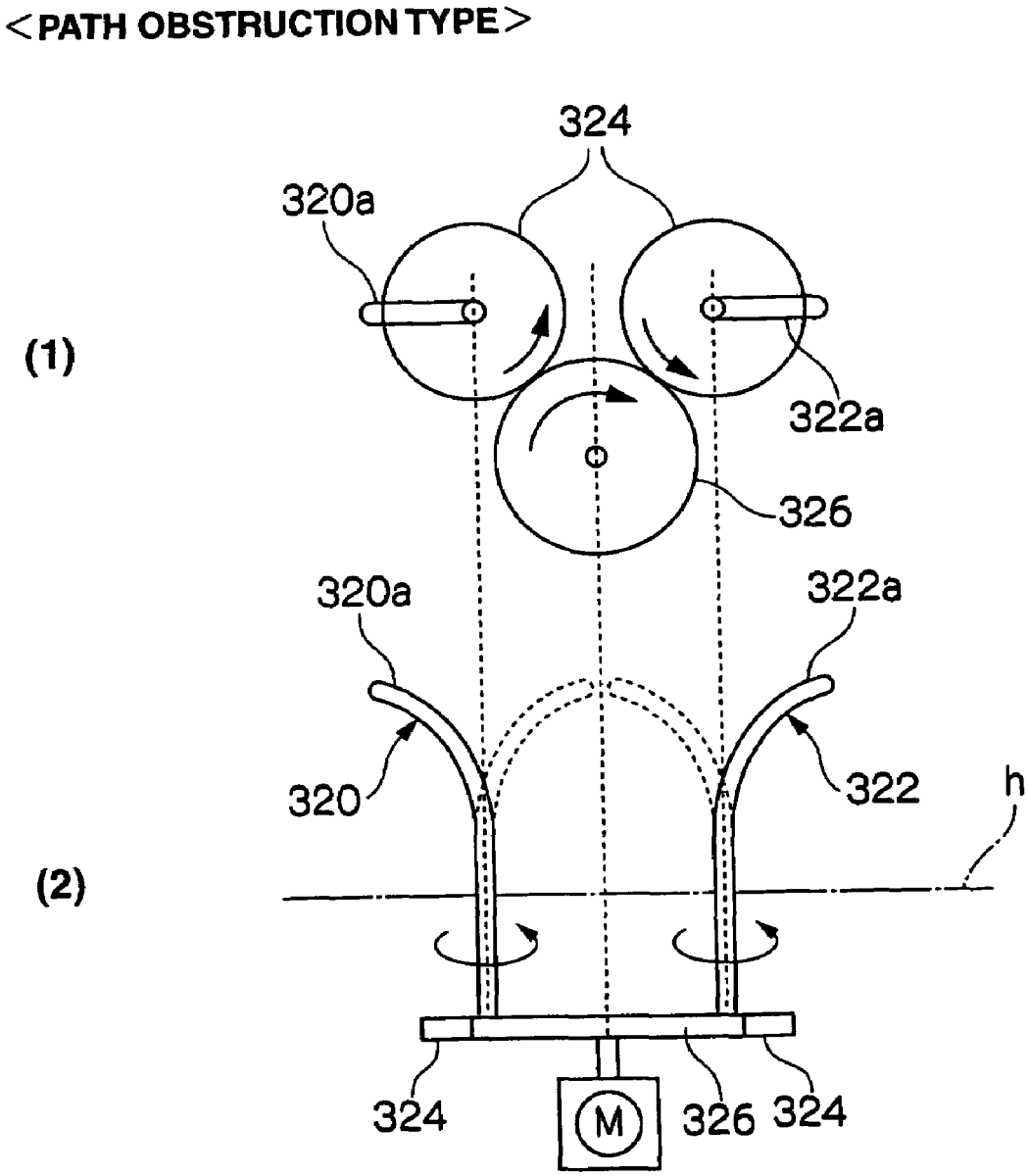
FIG. 4(1) is a plan view of a specific embodiment of the obstruction means (obstruction while the prize is being transported), and FIG. 4(2) is a side view thereof.

Next, a specific embodiment of the obstruction means (obstruction during the prize transfer path). FIG. 4(1) is a plan view thereof, and FIG. 4(2) is the side view thereof. In this example, a pair of unciform protrusions 320, 322 toward the tip thereof is protruding from the driven gear 324 toward the antigravity direction, and, when the driven gear 324 rotates pursuant to the rotation of the drive gear 326, the unciform portions 320*a*, 322*a* at the tip of the unciform protrusions will rotate in the horizontal direction. When the prize acquisition device passes near this pair of unciform protrusions, the prize may drop from the arm if the tip of the unciform protrusions and the arm 7*b* grabbing the prize, the mechanical unit 7 or the prize come in contact. Since the direction of the tip of the unciform protrusions will change periodically pursuant to the rotation of the driven gear, the player will have to control the foregoing moving means with the operation device to adjust the timing of passing the mechanical unit 7 through the obstruction means so as to prevent the prize from coming into contact with the protrusions 320, 322. As a result of skillfully moving the mechanical unit in the X, Y directions, the player will be able to avoid the obstruction means. The obstruction means is constituted from an interfering body for interfering with the prize, and a drive mechanism for periodically driving (rotating or reciprocating, as described later) this interfering body. Incidentally, in FIG. 4, h is the face to which the prize is to be disposed in the game space.

Figure 5:
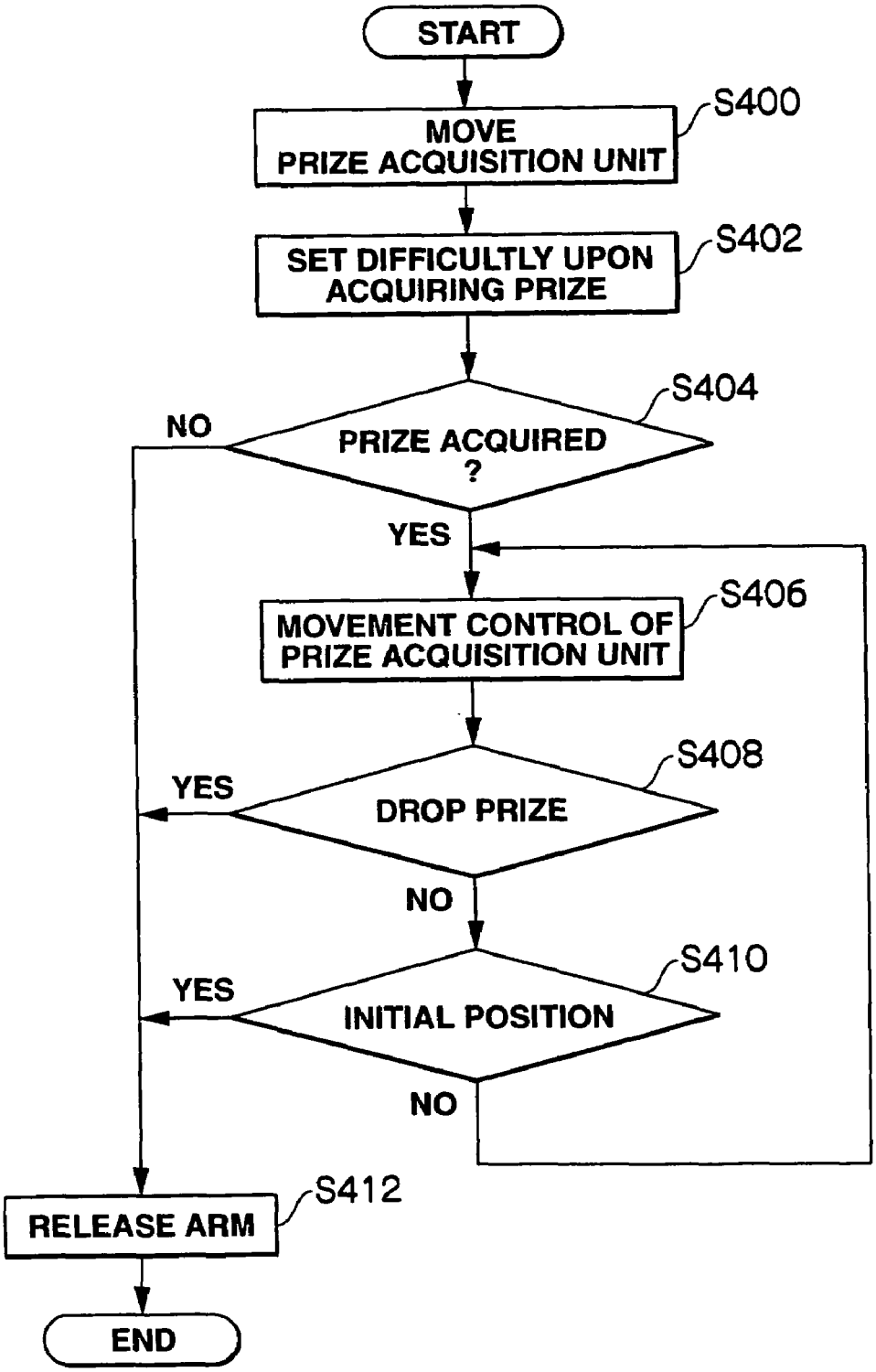
FIG. 5 is a flowchart showing the control action of the obstruction device with the control means.

FIG. 5 is a flowchart showing the control action of the obstruction device controlled with the control means. When the game is started, the microcomputer constituting the control system depicted in FIG. 3 receives an operation signal from the operation means, and moves the prize acquisition unit to a position of the prize targeted by the player (S400). The control device judges the necessity of adjusting the difficulty upon acquiring the prize based on the game program (S402), and, when it is necessary to adjust the difficulty, determination processing of the difficulty is performed, and the success or failure of the acquisition of the prize is judged (S404).

When this judgment is disaffirmed, the control device returns the prize acquisition means to the initial position, and, when this judgment is affirmed, the control system moves the prize acquisition means to the initial position (regardless of this position being at the position of the prize drop-in slot or not) according to the operation signal from the operation means (S406). During this movement, the control device controls the movement of the prize acquisition means upon receiving the operation signal from the operation device. In other words, the movement of the prize acquisition means can be controlled so as to avoid the obstruction means. Next, the control system judges whether the acquisition of the prize has been obstructed (S408); that is, whether the prize dropped from the arm, and, when the prize was dropped from the arm, this is notified by displaying such message on a monitor. When the prize safely passes through the obstruction area without falling from the arm, whether the prize acquisition unit reached the initial position is judged (S410), and, at the initial position, the mechanical unit 7 is controlled so as to release the arm, and the prize is dropped into the prize drop-in slot. Steps 404 and 408 may be omitted as necessary.

Incidentally, in addition to the above, the following control may also be performed. The prize acquisition unit 5 is moved to a position above the target prize in accordance with the operation signal from the operation means, and the arm is opened. While the arm is in an open state, the prize acquisition unit is lowered with the elevation means 6. After the arm is closed, the prize acquisition unit 5 is raised. As necessary, whether the prize has been acquired is judged, and, subsequently, if it is judged that a prize has been acquired, the obstruction means is activated. If the prize has not been acquired, the obstruction means is not activated.

Here, in the step of "activating the obstruction means", the following processing steps may be performed so as to change the degree of obstruction with the obstruction means according to the difficulty at the start of the game. For example, the control unit will adjust the gripping strength of the arm with the gripping strength adjustment means provided inside the prize acquisition unit based on the difficulty parameter at the start of the game. Specifically, the motor is driven to change the spring length of the spring for determining the gripping strength of the arm. Next, the prize acquisition unit 5 is moved to a position above the target prize according to the operation signal from the operation means, and the arm is opened. While the arm is in an open state, the prize acquisition unit is lowered with the elevation means 6. After the arm is closed, the prize acquisition unit 5 is raised. Whether the prize has been acquired is judged, and if a prize has been acquired, the activation pattern of the obstruction means is determined in accordance with the difficulty parameter. Next, the obstruction means is driven based on the determined activation pattern. If a prize has not been acquired, the obstruction means is not activated. The control unit changes the difficulty parameter in accordance with the adjustment made by the foregoing gripping strength adjustment means. For example, when it is judged that the gripping strength is set to "strong", the activation pattern of the obstruction means is set to "difficult", and, in the example shown in FIG. 4, the rotation speed of the obstruction means is increased.

Figure 6:
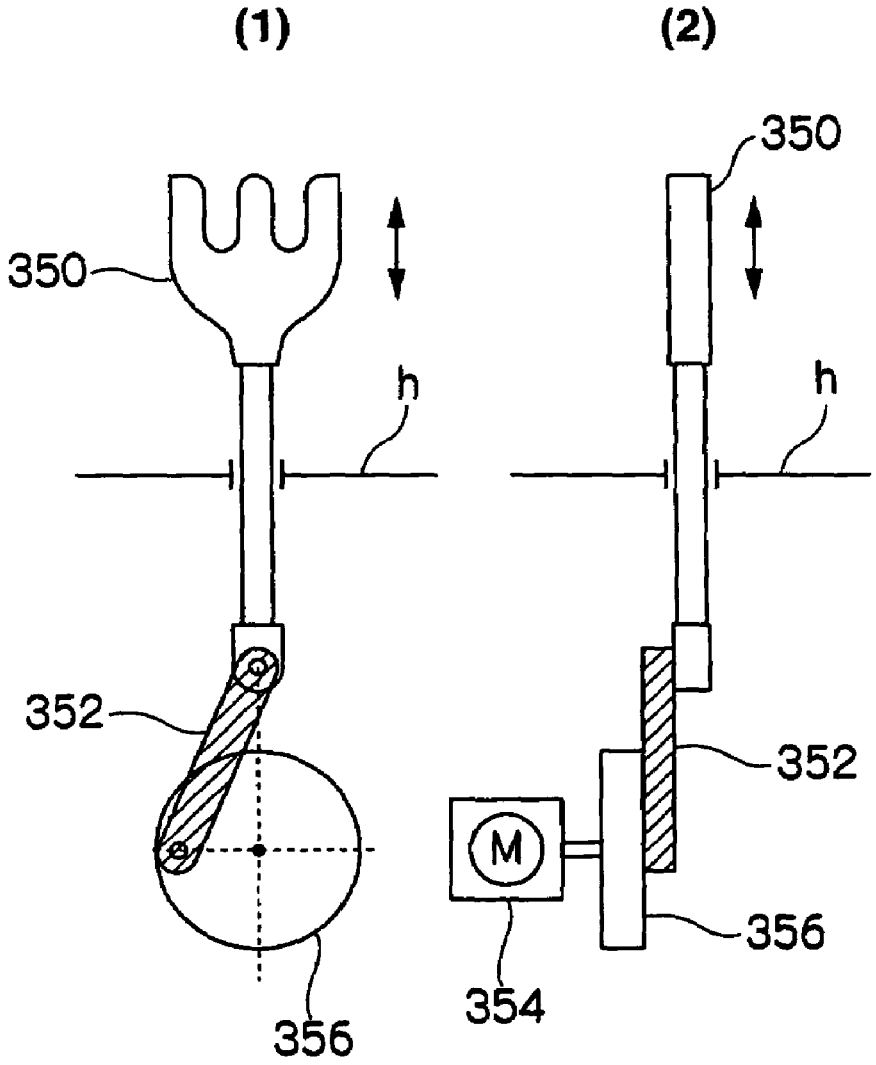
FIG. 6(1) is a front view of another embodiment of the obstruction means in the middle of the transport path of the prize, and FIG. 6(2) is the side view thereof.

FIG. 6 is a diagram showing another embodiment of the obstruction means, and the base end of a fork 350 appearing in the prize housing unit from the game space field h is connected to a crank shaft 352. This crank shaft 352 is connected to a noncentral position of a disk 356 to be rotated with a motor 354. As a result of the motor 354 being rotated, this fork 350 rises and falls from the field toward the prize housing unit in a prescribed frequency. Incidentally, FIG. 6(1) is a front view of the obstruction means, and FIG. 6(2) is the side view thereof.

Figure 7:
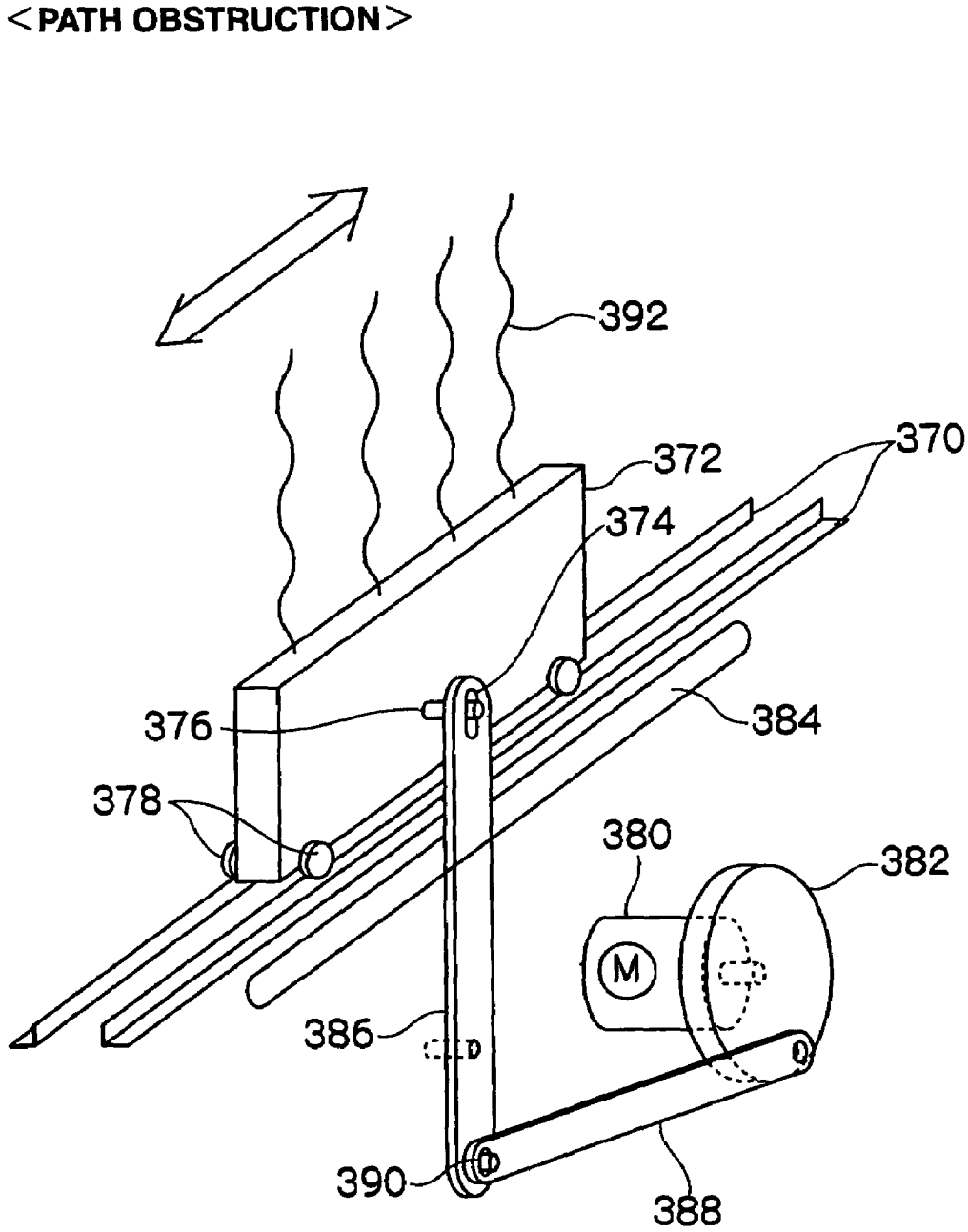
FIG. 7 is a perspective view showing another example of the obstruction means in the middle of the transport path of the prize.

FIG. 7 is another example of the obstruction means in the middle of the moving path of the prize, and a slider 372 which slides on a guide 370 formed on the field of the game space is illustrated. A pin 376 protruding from the side face of this slider is engaged inside a slotted hole 374 of a first connecting shaft 386, and the end of a second connecting shaft 388 connected to a slotted hole 390 of the end of the first connecting shaft via a pin is connected to a noncentral position of a disk 382. When the motor 380 rotates, the disk 382 also rotates, and the second connecting shaft in which the end thereof is connected to a noncentral position of the disk performs a crank motion, and makes the slider 372 reciprocate along the guide 370 via the first connecting shaft 386. Reference numeral 384 is a field hole, and the first connecting shaft 386 is protruding from this hole. Reference numeral 392 is a resin member formed in a meandering shape and protruding in a perpendicular direction from the slider, and a plurality of such members is fixed to the slider. When the prize acquisition unit comes in contact with the obstruction member while it is heading toward the prize drop-in port, the prize may fall from the arm. Incidentally, as with the foregoing embodiment, the difficulty can be adjusted by changing the moving frequency of the obstructive interfering body. In other words, the difficulty will increase when the rotation speed of the motor is increased.

Figure 8:
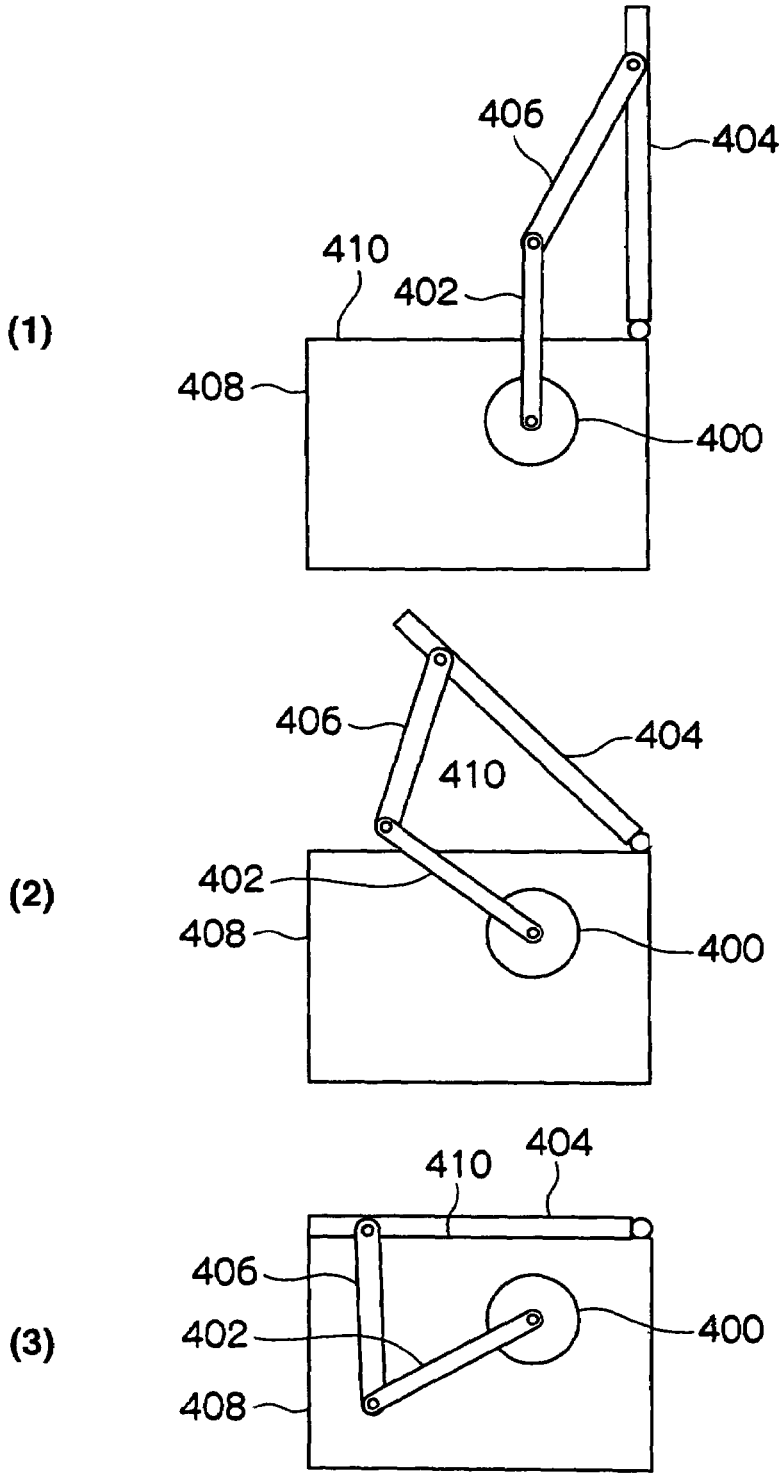
FIG. 8(1), FIG. 8(2) and FIG. 8(3) each is a front view of the obstruction means at the stage of acquiring the prize.

FIG. 8 is a diagram pertaining to an obstruction means to be used at the stage of dropping the prize into the drop-in slot, and this obstruction means is constituted from a motor 400, a first connecting shaft 402 connected to this motor, and a second connecting shaft 406 in which the tip thereof is connected rotatably with the end of the first connecting shaft, and the end thereof is connected to a cover 404. Reference numeral 408 is a guide of the prize drop-in port, and the upper end of this guide is the opened prize drop-in slot 410. The motor is a normal/reverse rotation motor, and the edge of the first connecting shaft is connected to the motor in a relatively unrotatable manner. The lower end of the cover is supported so as to be rotatable in a counterclockwise direction against the right end of the prize drop-in guide. Here, if the motor rotates in the counterclockwise direction, after the processes of (1)→(2)→(3), the cover closes the opening end of the prize drop-in guide. If the motor rotates in the clockwise direction, the cover will open the prize drop-in slot upon taking the foregoing processes in reverse. As a result of the normal/reverse rotation of the motor being periodically repeated, the closing or opening timing of the opening end can be adjusted. Incidentally, when the prize acquisition means reaches a position above the opening end, the arm is automatically released to drop the prize without requiring any special operation from the player. Further, the user may also determine the timing of dropping the prize that has been acquired. For example, a drop button is provided to the operation unit, and, as a result of pushing the drop button, the control unit will receive the operation signal, and execute control for driving the motor for opening and closing the arm.

Figure 9:
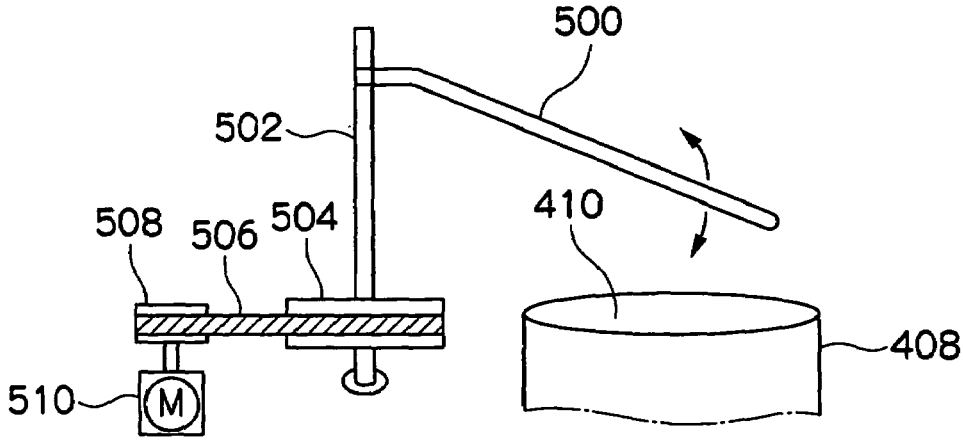
FIG. 9(1) and FIG. 9(2) each show a diagram showing another example of the obstruction means in a prize drop-in port.
Figure 9:
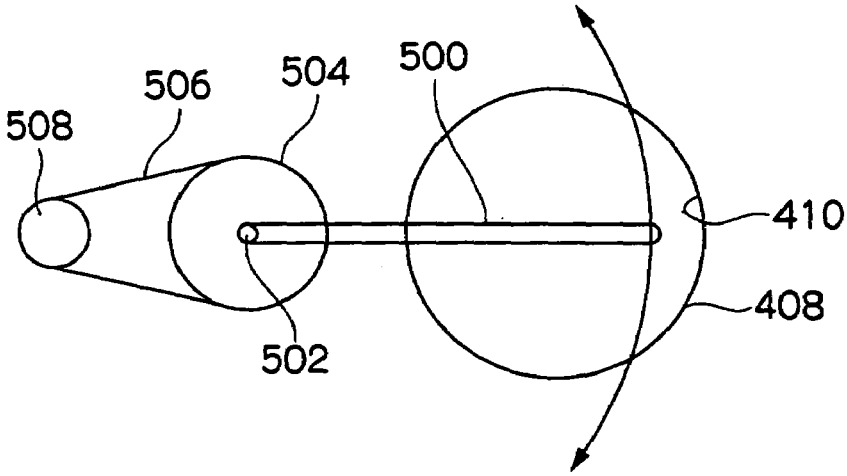

FIG. 9 is another example of the obstruction means in the prize drop-in port, and this obstruction means is constituted from a bar 500 that reciprocally rotates above the prize drop-in slot 410 of the prize case 408, a shaft 502 connected to this bar, a rotor 504 for rotating this shaft, and a rotor 508 and a motor 510 for rotating this rotor via a belt 506. As a result of the motor 510 periodically engaging in normal/reverse rotation, the bar 500 will reciprocally rotate within the range of a fan shape above the prize drop-in slot 410. When the prize collides with this bar the moment the prize falls from the prize acquisition means, the prize will not drop into the prize drop-in slot, and will fall within the field where the prizes are disposed.

Incidentally, the user may also determine the timing of dropping the prize that has been acquired. For example, a drop button is provided to the operation unit, and, as a result of pushing the drop button, the control unit will receive the operation signal, and execute control for driving the motor for opening and closing the arm.

Figure 10:
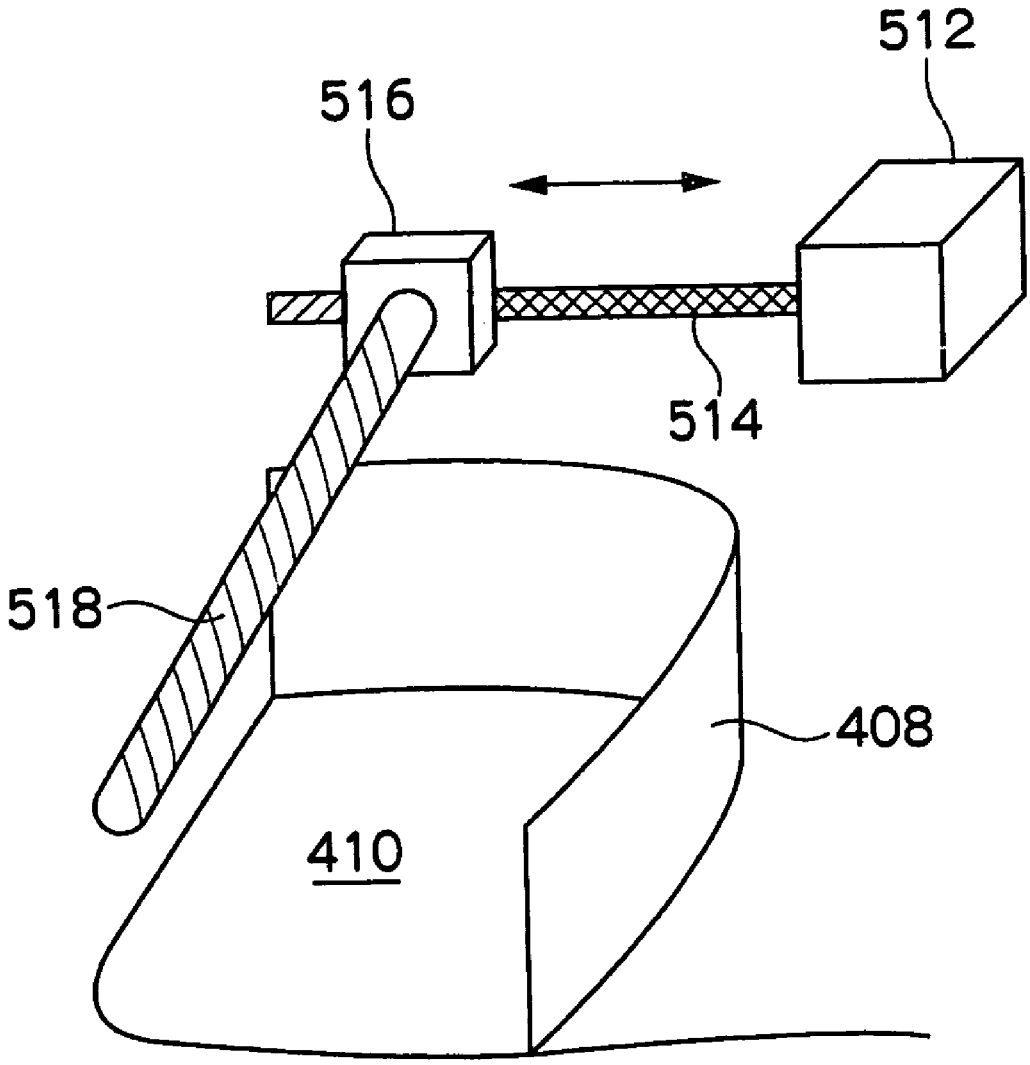
FIG. 10 is a diagram showing yet another example of the obstruction means.

FIG. 10 is yet another example of the obstruction means, and this obstruction means is constituted from a bar 518 that moves above the prize drop-in slot 410 of the prize drop-in guide 408, a ball screw shaft 514, and a motor unit 512. When the motor unit is driven, the screw shaft 514 rotates and a ball screw nut 516 moves along the ball screw shaft 514.

Incidentally, the user may also determine the timing of dropping the prize that has been acquired. For example, a drop button is provided to the operation unit, and, as a result of pushing the drop button, the control unit will receive the operation signal, and execute control for driving the motor for opening and closing the arm.

Figure 11:
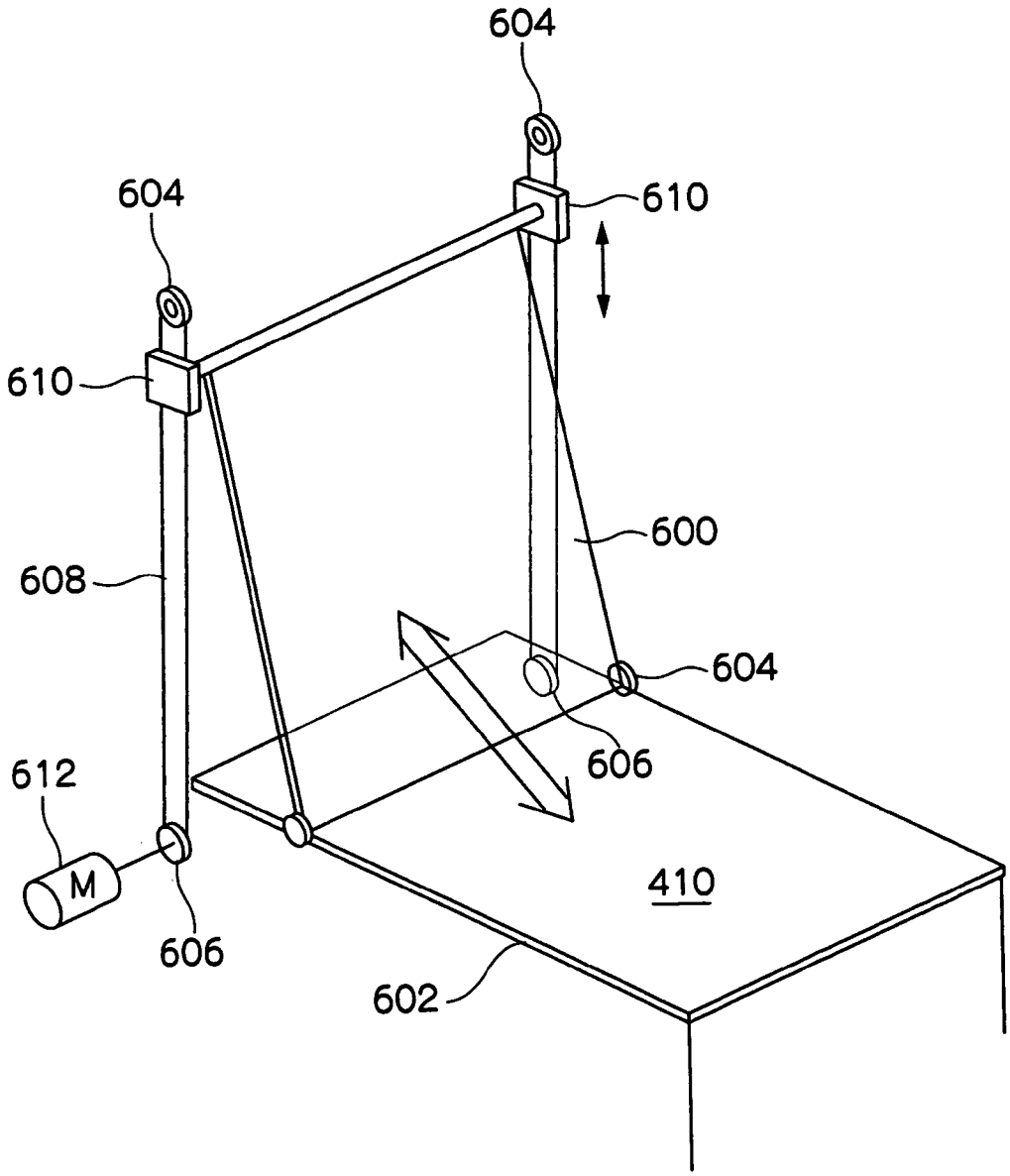
FIG. 11 is a diagram showing another modified example.

FIG. 11 is yet another modified example, and illustrates an obstruction means constituted from a cover for opening and closing the prize drop-in slot, and a drive mechanism for driving this cover. Reference numeral 602 is a guide, and a roller 604 attached to both ends of the cover rolls on this guide. The other ends of this cover are connected to a pair of pulleys 604, 606 and a pair of movable units 610 that moves up and down with the belt 608, and, when the drive pulley 606 is subject to normal/reverse rotation within a prescribed angle based on the normal/reverse rotation of a motor 612, the movable unit 610 fixed to the belt will move up and down, the cover 600 will move in the direction shown with the arrow, and the prize drop-in slot 410 is opened and closed thereby.

Incidentally, the user may also determine the timing of dropping the prize that has been acquired. For example, a drop button is provided to the operation unit, and, as a result of pushing the drop button, the control unit will receive the operation signal, and execute control for driving the motor for opening and closing the arm.

Figure 12:
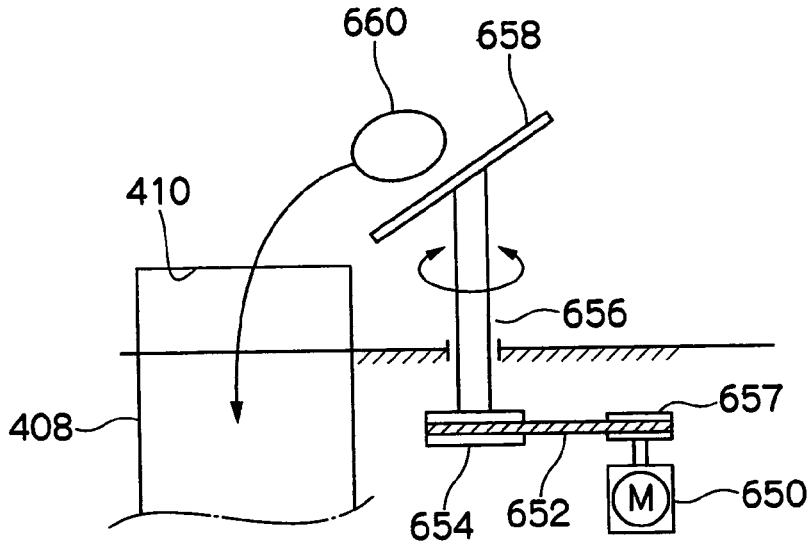
FIG. 12 is a diagram showing yet another modified example of the obstruction means.

FIG. 12 is yet another modified example of the obstruction means, and this obstruction means is constituted from a pulley 654 provided at a position adjacent to the prize drop-in guide 408 and connected to a drive pulley 657, via a belt 652, to be driven with a motor 650, a shaft 656 protruding perpendicularly from this pulley, and a panel 658 connected to this shaft in an oblique manner. When the motor 650 rotates, the oblique panel 658 rotates around the shaft 656. When the oblique face of the oblique panel 658 is inclined toward the direction of guiding the prize to the drop-in slot 410, and the prize 660 dropped from the arm of the mechanical unit 7 that has been released collides with the oblique panel 658 in good timing, the prize 660 will drop into the prize drop-in slot 410. If this is done poorly, the prize will not drop into the prize drop-in slot. Incidentally, the user may also determine the timing of dropping the prize that has been acquired. Specifically, a drop button is provided to the operation unit, and, as a result of pushing the drop button, the control unit will receive the operation signal, and execute control for driving the motor for opening and closing the arm.

As described above, according to the prize acquisition game of the foregoing embodiments, the amusement of game play in a prize acquisition game machine can be diversified by adding the effect of obstruction during the process of the prize being transported to the prize drop-in area and/or upon the prize being dropped into the prize drop-in slot.

The prize acquisition game machine described in each of the foregoing embodiments may also be provided with an avoidance means against the obstruction means. Taking the example illustrated in FIG. 4, for instance, this would be a switch for stopping the rotation of the unciform protrusion 322. As a result of the player pushing this kind of switch on the operation panel, the drive of the obstruction means can be temporarily stopped to ease the acquisition of the prize. However, if this means is provided without limitation, since the provision of an obstruction means will become insignificant, it is desirable to enable the drive of the avoidance means under regulated conditions. For example, the duration of the avoidance means may be limited, or, after the avoidance means is used, the difficulty parameter of the obstruction means may be changed to increase the degree of obstruction.

Figure 13:
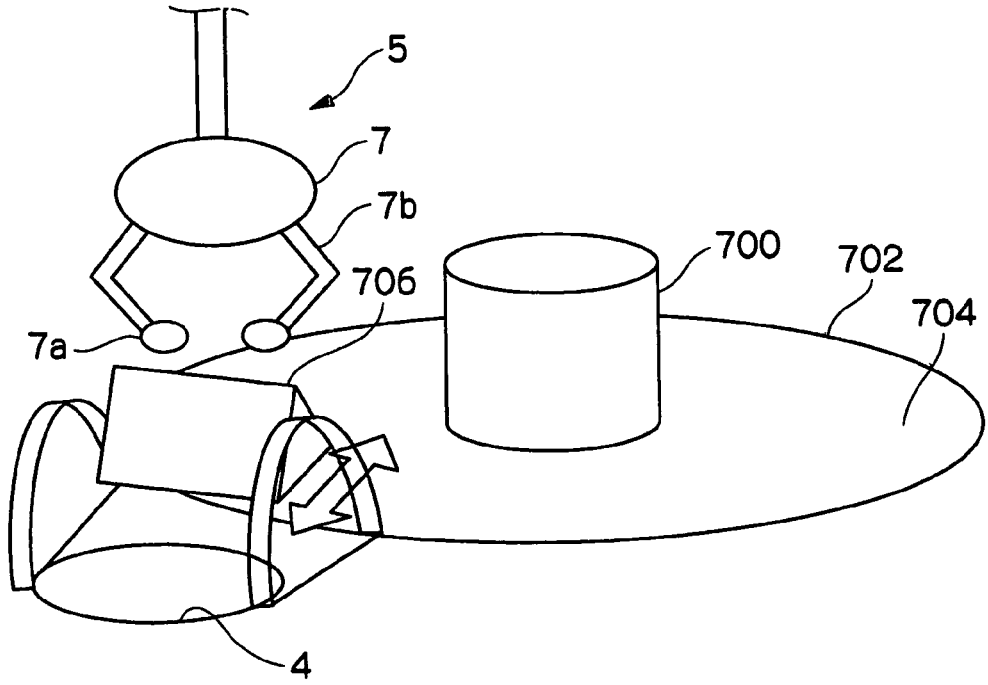
FIG. 13 is a perspective view pertaining to yet another modified example of the obstruction means.

Another embodiment is now explained. FIG. 13 is a perspective view of the obstruction means near the prize payout slot 4. Reference numeral 702 is a table 702, which is a means for mounting a prize that rotates with a motor not shown around the center 700. This table 702 in the shape of a cone-shaped hollow, and numerous prizes such as candy are housed inside 704. The prize acquisition unit 5 grabs the prizes on the table, and drops the prizes into the prize payout slot 4.

Figure 14:
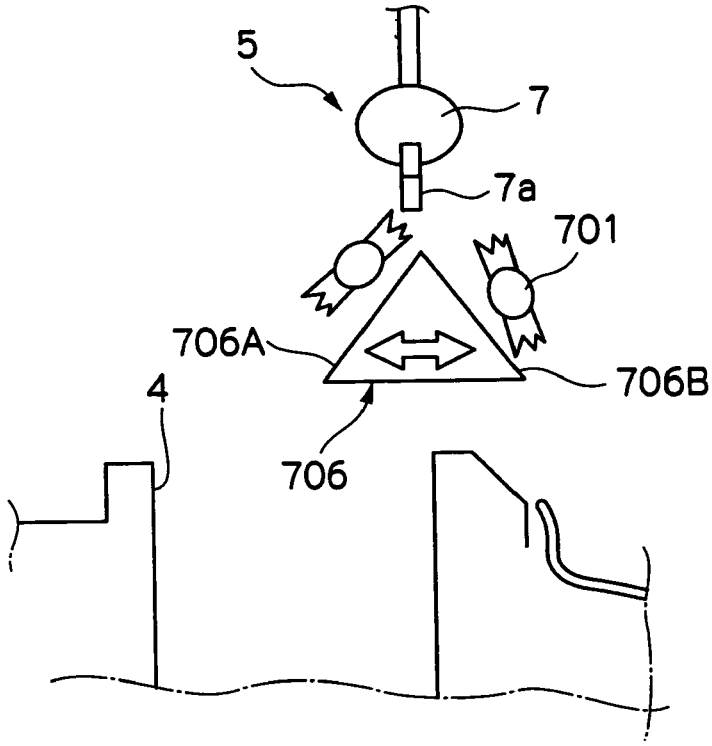
FIG. 14 is a view showing a frame format of the operation mode thereof.

As shown in FIG. 14, the obstruction means comprises, near the prize payout slot 4, a triangular slider 706 that reciprocally moves toward the prize payout slot. Since the slider is reciprocating, the position which the prize dropped from the prize acquisition unit will contact the slider will change. In the initial state, the prize acquisition unit is set to come to a position directly above the slider positioned in the center of the reciprocating motion. When the prize 701 dropped from the prize acquisition unit 5 contacts the inclined face 706A on the side of the prize payout slot of the slider, the prize will be guided to the side of the prize payout slot and dropped into the prize payout slot 4. Meanwhile, when the prize contacts the inclined face 706B on the opposite side, the prize will not be dropped into the prize drop-in slot 4, and will drop onto the table 702. As described above, although the slider will not block the prize payout slot 4, it will interfere with the dropping line of the prize into the prize payout slot 4 and obstruct the acquisition of the prize.

Figure 15:
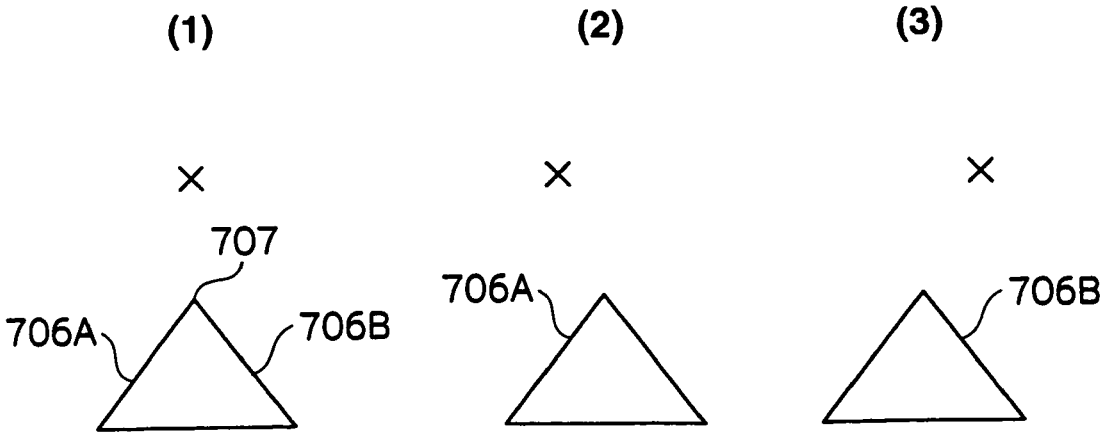
FIG. 15(1), FIG. 15(2) and FIG. 15(3) each is another view showing the frame format thereof.

FIG. 15 is a diagrams showing the relationship of the position (x) to which the prize is to be dropped and the slider. FIG. 15(1) shows a case where the prize in above the center of reciprocation when the slider is reciprocating. In this case, when the prize acquired with the prize acquisition unit is dropped toward the slider 707, the prize will be dropped into the prize payout slot at a probability of roughly 50%. FIG. 15(2) shows a case when the slider moves to the opposite side of the prize payout slot. In this state, since the prize will contact the inclined face 706A, the prize will drop into the prize payout slot in most cases. FIG. 15(3) shows a case where the slider moves to the side of the prize payout slot. In this state, since the prize will contact the inclined face 706B, the prize will not be guided to the prize payout slot in most cases.

Figure 16:
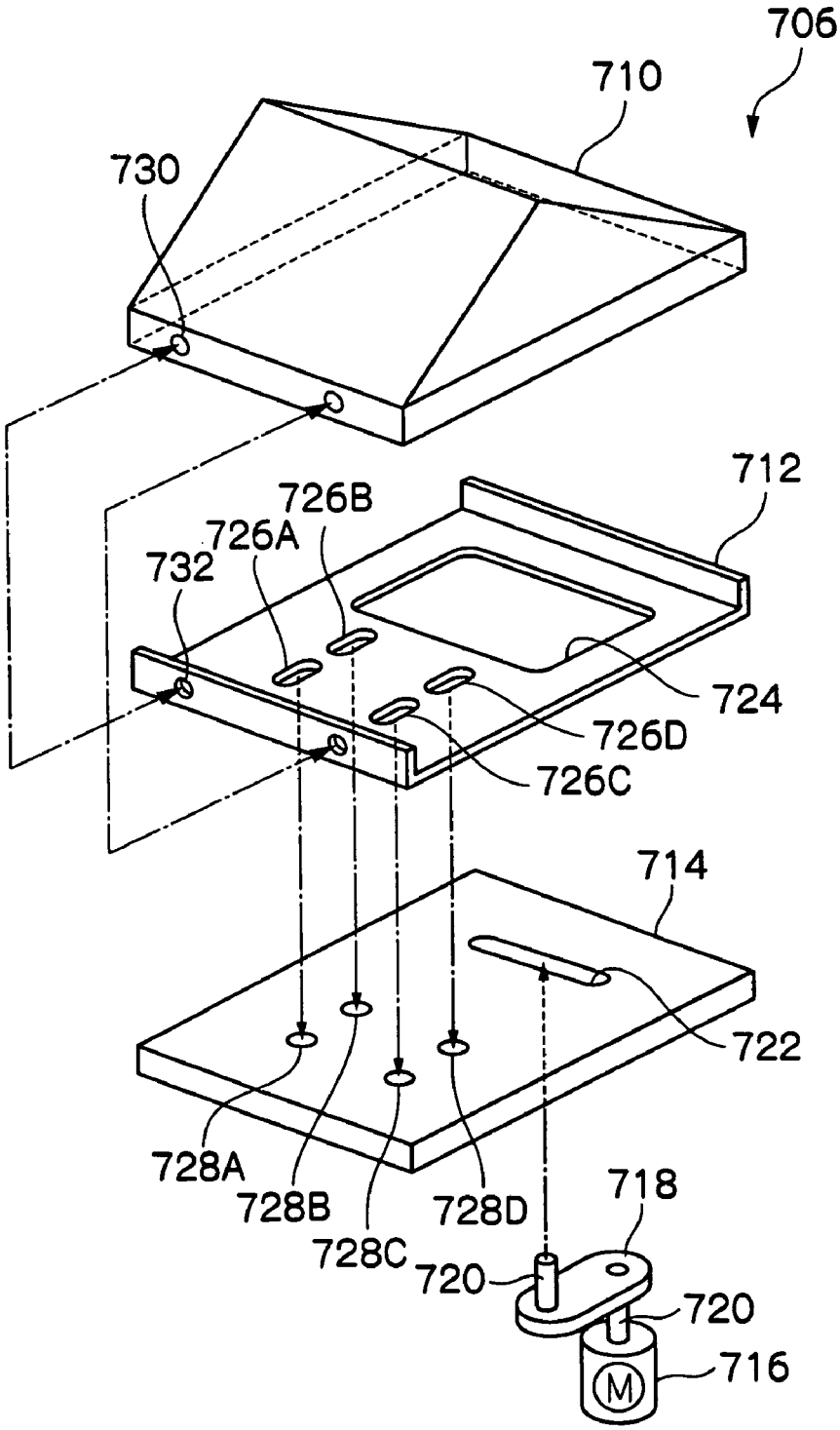
FIG. 16 is a perspective view of the assembly of the obstruction means.

FIG. 16 is an exploded perspective view of the slider. The slider 706 is constituted from a triangular casing 710, a case fixing plate 712, a base plate 714, and a motor 716. The case fixing plate 712 fixes the case 710, and is supported with the base plate 714.

A crank arm 718 is fixed to the rotating shaft 720 of the motor 716, a minor axis from the end of the crank arm is inserted into a slotted hole 722 of the base plate 714. A hole 730 is provided to the front edge of the casing 710, and, as a result of fitting this hole 730 to the screw hole 732 of the plate 710 and screwing them together, the casing 710 can be fixed to the plate 712.

The holes 726A to D of the plate 712 respectively correspond to the screw holes 728A to D of the base plate 714. As a result of screwing the screws to the corresponding screw holes, both plates can be mutually fixed. Since the screw holes 726A to b of the plate 712 have a slotted shape, the fixing position of both plates can be relatively shifted within the width thereof. Reference numeral 724 of the plate 712 is an escape hole for avoiding the interference with the minor axis 720 protruding from the slotted hole 722 of the plate 714. Thereby, when the plate 712 is fixed to the plate 714 in slight misalignment, interference with the minor axis 720 can be avoided.

Figure 17:
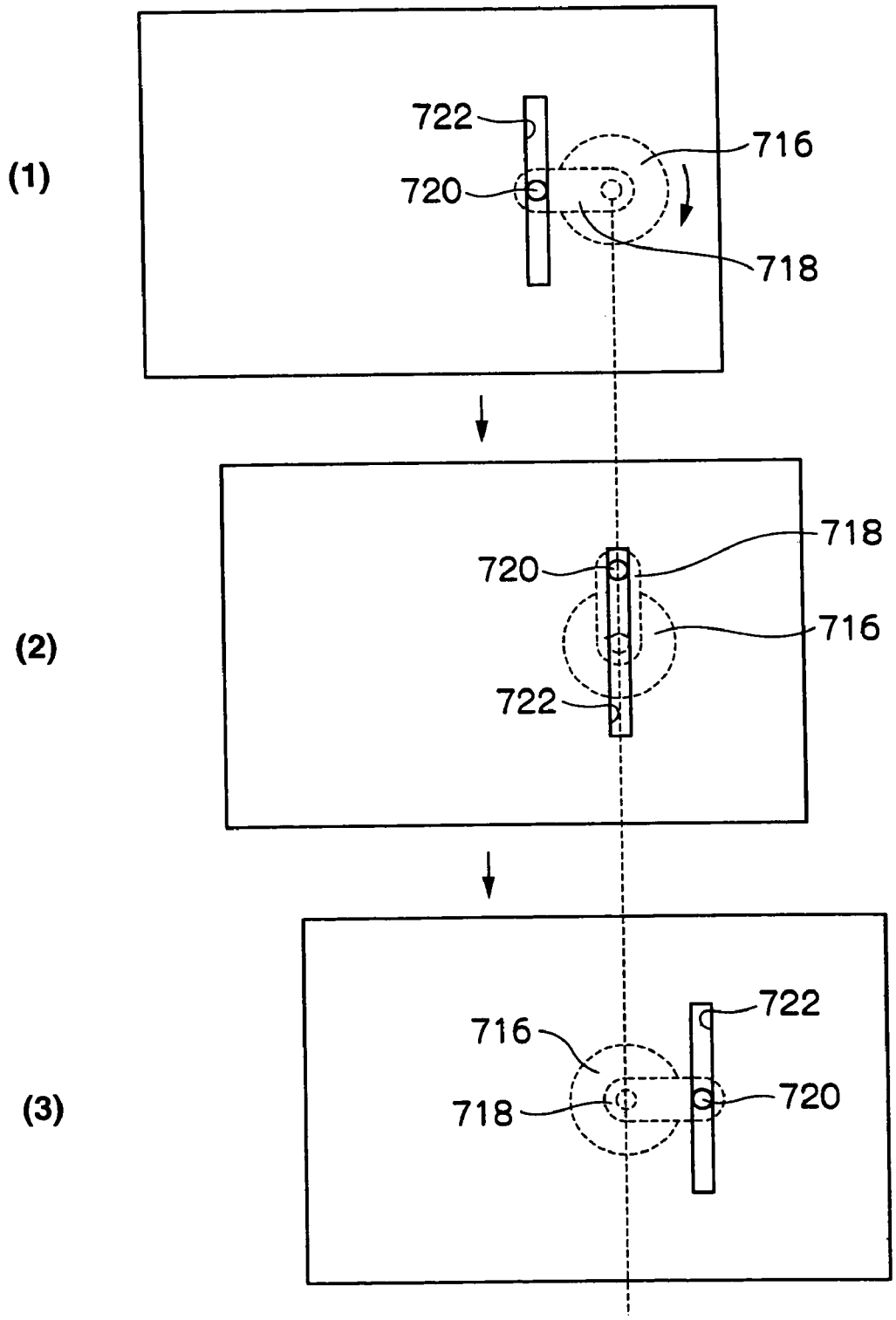
FIG. 17 is another view showing a frame format of the operation of the obstruction means.

In other words, as shown in FIG. 17, when the motor 716 is rotated in a state where the respective components illustrated in FIG. 16 are assembled, the minor axis 720 will circulate around the rotating shaft 720 of the motor. Since the minor axis 720 will contact the inner wall of the slotted hole of the plate 722, when the minor axis 720 rotates (when the motor rotates in the clockwise direction), the plate 714 reciprocates from (1)→(2)→(3)→ . . . (1) as shown in FIG. 17. FIG. 17(1) is a state where the plate is closest to the prize payout slot, FIG. 17(3) is a state where the plate is farthest from the prize payout slot, and FIG. 17(2) is a state where the plate is in an intermediate position. Since the plate 714 is fixed to the plate 712, and the casing 710 is fixed to the plate 712, it is possible to reciprocate a triangular slider as described above. The motion of the plate between (1)-(3)-(1) may be conducted with the normal rotation of the motor, or this may be driven by switching the rotating direction after (3) to be reverse. The position detection of the plate at (1) and (3) is possible by providing a limit switch as the detection means.

When the screw holes 728A to D of the plate 714 are fitted to the center of the slotted holes 726A to D of the plate 712, the center of reciprocation of the housing 710 will match the drop position of the prize as shown in FIG. 15(1). Nevertheless, as a result of shifting the screw holes 728A to D in relation to the slotted holes 726A to D, the center of movement of the housing 710 can be made to be offset against the drop position of the prize as shown in FIG. 15(2) or (3). Thereby, the amount of displacing the plate 712 (housing 710) against the plate 714 can be physically adjusted, and an adjustment means for adjusting the difficulty of acquiring prizes can be realized. In other words, it is possible to adjust the probability of the inclined face 706A for guiding the prize to the prize payout slot coming into contact with the prize.

As another method of adjusting the difficulty of adjusting prizes with the obstruction means, there is a method of controlling the motor as the drive means. For example, the rotation speed of the motor is changed in the transfer from the state shown in FIG. 15(2) to the state of FIG. 15(3), and in the transfer from the state shown in FIG. 15(3) to the state of FIG. 15(2). As a result of reducing the rotation speed of the motor when transferring from the state of FIG. 15(2) to FIG. 15(3), and increasing the rotation speed of the motor when transferring from FIG. 15(3) to FIG. 15(2), the difficulty upon acquiring the prize can be lowered, or the difficulty can be increase by performing the opposite process. Further, when the stop time of stopping the slider when it reaches the position of FIG. 15(3) is made to be longer in comparison to when it reaches the position of FIG. 15(2), the prize can be easily acquired, or the acquisition of the prize can be made difficult by performing the opposite process. Further, an operation means may be provided to enable the user to operate the timing of dropping the prize from the prize acquisition unit.

Figure 18:
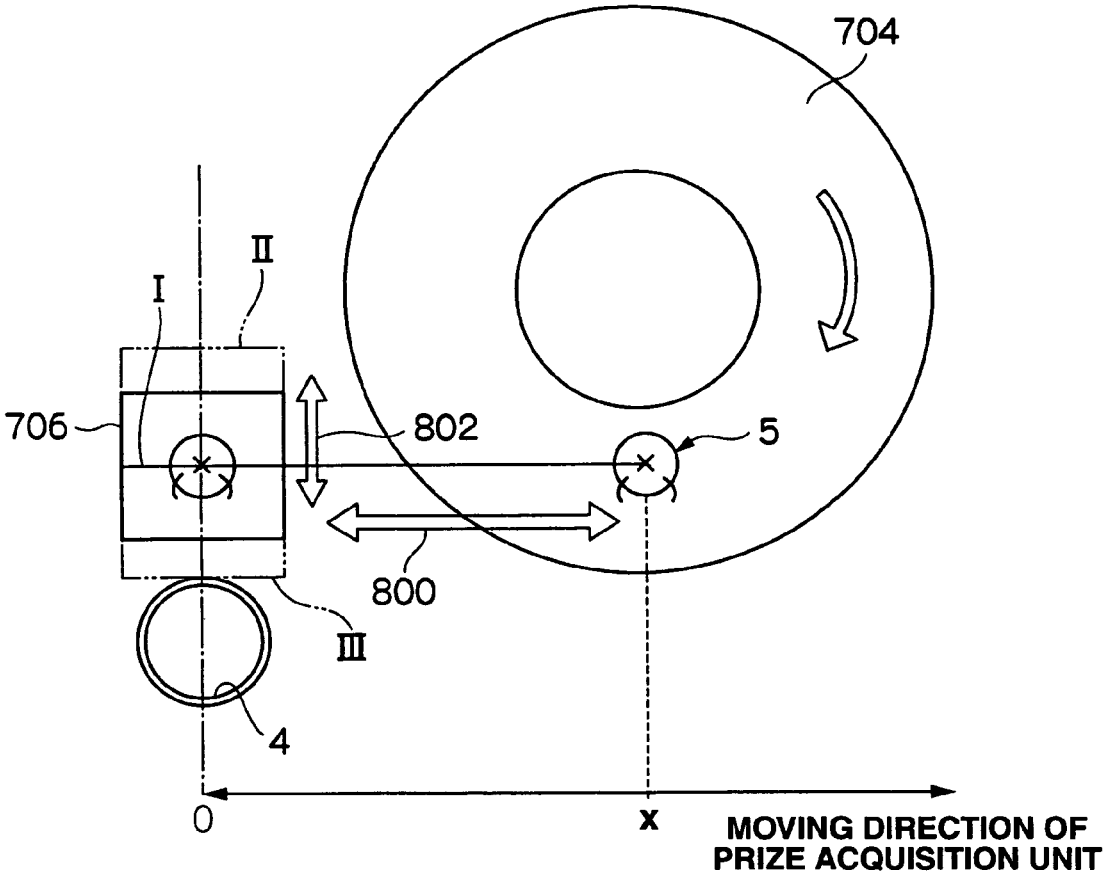
FIG. 18 is another view showing a frame format of the operation of the obstruction means.

The operation of the present embodiment is now explained. When the control system depicted in FIG. 3 detects the insertion of a coin, it makes the slider 706 start reciprocating. Simultaneously, the prize acquisition unit 5 moves in the direction (X direction) shown with reference numeral 800 in FIG. 18, and stops it at the prize acquisition position (x) above the table 704. Next, when the user pushes the operation switch as the operation means, the control means that received the operation signal stops the rotation of the table 704, opens the arm, and lowers the mechanical unit 7. When the lower end limit switch (descending detection means) for detecting the descending of the mechanical unit is turned ON, the drive means for opening/closing the arm is driven so as to close the arm at the tip of the mechanical unit. After the arm is closed, the mechanical unit is raised, and, when the ascending limit switch (ascending detection means) is turned ON, the rotation of the table is resumed. Next, the prize acquisition unit is moved from the target position to the initial position (0 point position).

When the detection switch detects that the prize acquisition unit moved to the initial position, the control means releases the arm. Next, the reciprocation of the slider 706 is stopped after the lapse of a predetermined time.

Incidentally, in the foregoing explanation, the motor as the drive means for rotating the table 704 can be stopped when the control means receives the operation signal from the operation switch. Here, the load caused by the prize colliding from the side when the prize acquisition unit is lowered can be avoided.

Here, an example of the control action of the motor as the drive means for moving the slider is as follows. When the control unit detects the insertion of a coin, it moves the slider from the top end position (III) to the bottom end position (II) of the slider in relation to the center (I) of reciprocation. Based on the detection means (switch) for detecting that the slider reached the bottom end, the control unit (CPU) that received the detection signal will stop the motor. A predetermined time is counted thereafter. The predetermined time is determined by the control means referring to the "stop time table" prestored in the storage unit based on the operation of the operator. When the predetermined time lapses, the control means restarts the drive of the motor. After the slider is moved from the bottom end position to the top end position, based on the detection means (switch) for detecting that the slider arrived at the top end position, the control means (CPU) which received the detection signal will stop the motor. This stop time is also set by the operator. After the lapse of the predetermined time, the control means restarts the drive of the motor. The movement of the slider is repeated until the detection means (switch) for detecting that the prize acquisition unit reached the initial position (position directly above the slider when it exists in the center of reciprocation, position directly above the drop-in slot, or a separate initial position) is turned ON, or until the game time set for one game elapses. As a result of adjusting the stop time, the difficulty of acquiring the prize can be adjusted. The stop time does not have to be pursuant to the operation of the operator, and may also be a value selected randomly by the control means from a plurality of figures stored in the table.

In the foregoing embodiment, although explained was a type where the prize acquisition unit could only move in the X direction, a type where the prize acquisition unit is able to move in the X and Y directions may also be employed. The operation of this type is as follows. After a coin is inserted, the x direction operation button (x motor) is turned ON, and this the subsequently turned OFF (x direction determination). Next, the same applies with the y direction operation button. Thereby, the target position of the prize acquisition unit will be determined. When the y direction operation button is turned OFF, the control unit opens the arm (drives the arm motor and views the rotational angle with an encoder). Next, the prize acquisition unit is lowered in the z direction (z motor is turned ON). When the descending limit switch is turned ON (motor is turned OFF in the z direction), the arm will close. Here, the arm motor is driven and the rotational angle is detected with the encoder. Next, the prize acquisition unit is raised in the z direction. When the ascending limit switch is turned ON, the z direction motor is turned OFF. The control means moves the x, y motors such that the prize acquisition unit will move toward a position directly above the reference position of reciprocation of the slider. The control means then detects the arrival of the prize acquisition unit at a position directly above the reference position of reciprocation of the slider, stops the X, Y motors, then subsequently releases the arm.

Although the obstruction means was explained as a movable type in the foregoing embodiments, an immovable obstruction means or an obstruction means that is merely installed may also be used.

Further, although the movement of the obstruction means was explained in the form of vibration, reciprocation and vertical motion, there is no particular limitation, and wind may also be blown on the prize. The movement of the obstruction means is controlled by the control means adjusting the parameter.

Incidentally, a guidance means (shooter) or the like for returning the prize, which didn't reach the prize drop-in slot from the prize acquisition unit due to the obstruction means, to the round table (prize housing unit) may also be provided.

What is claimed is:

1. A prize acquisition control method in a prize acquisition game device in which control means constituted from a microcomputer controls prize acquisition means that moves in a game space with a plurality of prizes disposed therein, and controls the acquisition of the prize, wherein said control means implements:

a step of moving said prize acquisition means to a target prize based on an operation signal from operation means operated by a player;

a step of moving the prize acquisition means that acquired said prize to a position where said prize can be paid out to the player; and a step of obstructing the payout of the prize before said prize acquisition means pays out the prize at said payout position.

2. A prize acquisition control method in a prize acquisition game device in which control means constituted from a microcomputer controls prize acquisition means that moves in a game space with a plurality of prizes disposed therein, and controls the acquisition of the prize, wherein said control means implements:

a step of moving said prize acquisition means to a target prize based on an operation signal from operation means operated by a player;

a step of moving the prize acquisition means that acquired said prize to a position where said prize can be paid out to the player; and a step of driving obstruction means for applying physical obstructive force to said prize acquisition means before said prize acquisition means reaches said payout position.

3. A prize acquisition game device, comprising:

operation means to be operated by a player;

a game space with a plurality of prizes disposed therein:

prize acquisition means disposed movably in said game space;

moving means for moving said prize acquisition means in said game space;

control means for controlling said moving means to move said prize acquisition means from an initial position to a target position in response to an operation signal from said operation means; and obstruction means provided in the middle of the path where said prize acquisition means returns from the target position to the initial position, and for obstructing the acquisition of the prize with said prize acquisition means.

4. A prize acquisition game device according to claim 3, wherein said obstruction means is constituted to reciprocate between a position that contacts the prize and a position that does not contact the prize acquired with said prize acquisition means moving along said path.

* * * * *